United States Patent [19]

Andersson

[11] Patent Number: 5,049,185

[45] Date of Patent: Sep. 17, 1991

[54] METHOD AND ARRANGEMENT FOR SUPPLYING LIQUID TO AN OVEN

[75] Inventor: Rolf Andersson, Stockholm, Sweden

[73] Assignee: AGA Aktiebolag, Sweden

[21] Appl. No.: 469,403

[22] PCT Filed: Sep. 22, 1988

[86] PCT No.: PCT/SE88/00490

§ 371 Date: May 8, 1990

§ 102(e) Date: May 8, 1990

[87] PCT Pub. No.: WO89/02937

PCT Pub. Date: Apr. 6, 1989

[30] Foreign Application Priority Data

Sep. 28, 1987 [SE] Sweden ..... 8703726

[51] Int. Cl.[5] ..... C21D 1/48

[52] U.S. Cl. ..... 75/529; 148/16

[58] Field of Search ..... 75/529; 148/16, 18, 148/20.3, 20.6; 266/250, 251, 252

[56] References Cited

FOREIGN PATENT DOCUMENTS 2450879 4/1975 Fed. Rep. of Germany .
0197864 8/1965 Sweden .
0304531 9/1968 Sweden .
1561119 2/1980 United Kingdom .

*Primary Examiner*—S. Kastler
*Attorney, Agent, or Firm*—Calfee, Halter & Griswold

[57] ABSTRACT

The disclosure relates to a method for supplying, with a lance (11), a liquid to a heat treatment oven, the liquid being vaporized by the oven heat and being introduced into the oven with the aid of a carrier gas, and a lance (11) for carrying the method into effect.

According to the method, the liquid is, with a carrier gas, atomized in an end of the lance (11) facing away from the interior of the oven, the atomized liquid and the carrier gas being supplied to a vaporization chamber (12) with an outlet aperture (14) directed towards the interior of the oven, in which chamber (12) the atomized liquid is vaporized by the oven heat during simultaneous cooling of the chamber (12), and the thus formed vapor and carrier gas are caused to depart from the vaporization chamber (12) of the lance (11) through the aperture designed as a nozzle (22).

The lance (11) includes a vaporization chamber (12) with an inlet (13) for the liquid and the carrier gas in one end of the lance (12), and an outlet (14) in the other end of the chamber (12), and a liquid atomizing nozzle (15) in the inlet (13) of the chamber (12).

6 Claims, 2 Drawing Sheets

METHOD AND ARRANGEMENT FOR SUPPLYING LIQUID TO AN OVEN

DESCRIPTION

Figure 1:
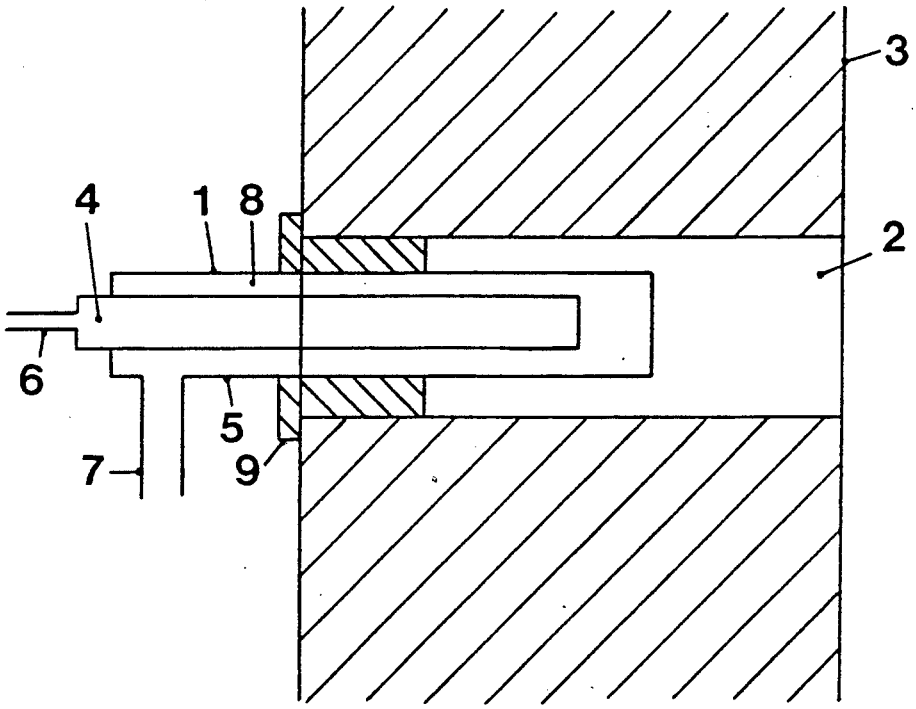

The present invention relates to a method for supplying with a lance a liquid to a heat-treatment oven, the liquid being vaporized by the oven heat and, with the assistance of carrier gas, introduced into the oven, and a lance for carrying out the method.

Heat treatment of steel of relatively high carbon content, for example annealing of ball-bearing steel, normally takes place in large ovens or furnaces with carefully regulated treatment atmosphere and temperature. The atmosphere normally consists substantially of nitrogen, with an addition of carbon monoxide and hydrogen. For correcting the carbon activity of the steel, use is made of additives of propane or air, depending upon the nature of the deviation.

The addition of hydrogen and carbon monoxide is normally effected by an addition of methanol which, in the oven, at a temperature of approx. 700° C. or higher, is thermally broken down into carbon monoxide and hydrogen. The methanol is supplied using a lance which is inserted in a channel through the oven wall.

A prior-art lance consists of a tube which is inserted in the oven wall and which thereby directs a jet of methanol towards the opposite wall. Thereupon, a portion of the methanol which is not thermally broken down before the jet reaches the opposite wall will impinge upon the wall and give rise to soot formation on the oven wall.

Another prior-art lance fundamentally consists of two concentric tubes, of which the outer is inserted further into the oven wall than the inner. Methanol is supplied to the inner tube and a carrier gas, normally nitrogen, is supplied to the annular space between the outer surface of the inner tube and the inner surface of the outer tube. The methanol in the inner tube is vaporized by the heat of the oven in the downstream end of the inner tube. The nitrogen from the annular space which, at the downstream end of the inner tube, merges into a circular chamber in which the inner tube discharges entrains the vaporized methanol and disseminates it more uniformly in the interior of the oven.

The disadvantage inherent in the first-described lance will be obvious to the skilled reader and primarily consists of soot formation on that oven wall which faces the lance. The disadvantage inherent in the second prior-art lance is primarily that the lance cannot be inserted a sufficient distance into the oven wall, since thermal breakdown may occur even before the methanol has departed from the lance. As a result, the lance cannot be inserted a sufficient distance into the channel of the oven wall, in order to avoid the risk that methanol impinges upon the channel wall.

One object of the present invention is to obviate the drawbacks described in tho foregoing in the employment of the prior-art lances and, thereby, to devise a method of supplying a substance which is liquiform at ambient temperature, preferably methanol, to a heat-treatment oven using a lance, such that the risk is avoided that methanol impinges on the channel wall of the oven in which the lance fs inserted, or on the opposing wall.

A further object of the present invention is to realize a method of obtaining more uniform distribution than has hitherto been possible of a liquid in vapour form in a heat-treatment oven.

Yet a further object of the present invention is to realize a lance for practical implementation of the method.

These objects will be attained by a method characterized in that the liquid is atomized in a carrier gas in an end of a lance facing away from the interior of the oven, that the atomized liquid and carrier gas are supplied to a vaporization chamber with an outlet which is directed towards the interior of the oven, in which chamber the atomized liquid is vaporized by the oven heat during simultaneous cooling of the chamber; and that the thus formed vapour and carrier gas are caused to depart from the vaporization chamber of the lance through the aperture acting as a nozzle, the lance employed in reducing the method into practice being characterized by a vaporization chamber with an inlet for the liquid and the carrier gas and an outlet at the other end of the chamber; and by a liquid atomizing nozzle in the inlet of the chamber.

The nature of the present invention and its aspects will be more readily understood from the following brief description of the accompanying Drawings, and discussion relating thereto.

Figure 2:
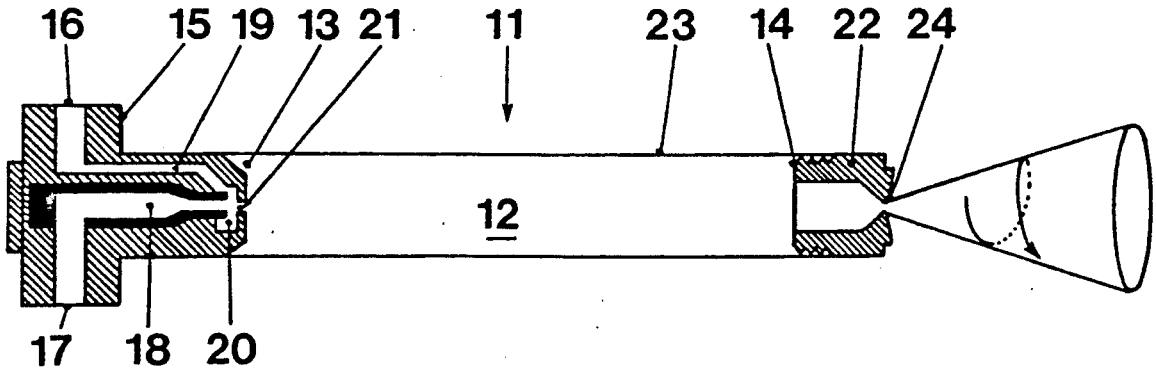
Figure 3:
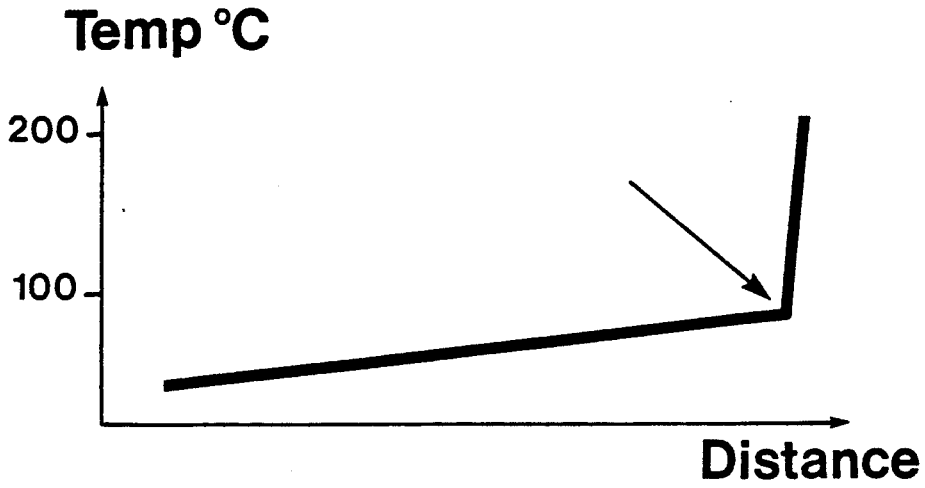
Figure 4:
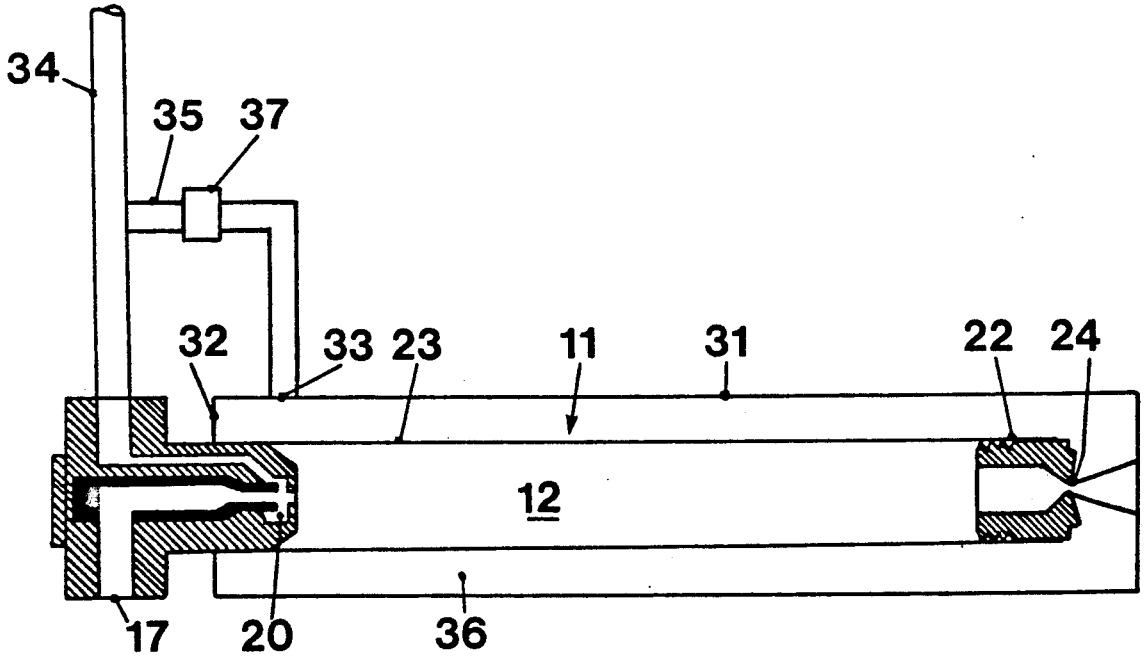

In the accompanying Drawings:

FIG. 1 schematically illustrates a prior-art methanol lance in cross-section parallel with the longitudinal axis of the lance, the lance being disposed in an oven channel;

FIG. 2 schematically illustrates a section of the liquid lance according to the present invention along its longitudinal axis;

FIG. 3 shows a graph in which the temperature of the tip of the lance is shown as a function of the position of the lance in the oven wall, i.e. the distance from the outside of wall; and FIG. 4 shows a further embodiment of the lance according to the present invention.

Referring to the Drawings, FIG. 1 shows a prior-art lance 1 which is disposed in a channel 2 in an oven wall 3, a portion of the oven wall 3 being shown in cross-section through the channel 2. The lance 1 comprises a first conduit 4, for instance a steel tube, for liquid if any, for instance methanol, the conduit being concentrically surrounded by a second conduit 5, for example a tubular member of a refractory alloy. In that end of the lance disposed outside the wall, there is an inlet 6 for the liquid to the inner conduit 4 and an inlet 7 for a carrier gas, normally nitrogen, to the space 8 defined by the two conduits 4 and 5, respectively. The lance 1 is centered in the channel 2 in that a socket 9 is fixedly secured on the outside of the oven wall.

When the lance 1 is put into operation, methanol is supplied to the conduit 4 through the intermediary of the inlet 6. Since a high temperature is maintained in the oven, for instance of the order of magnitude of between 700 and 1100° C., the methanol will, as it flows towards the interior of the oven, be exposed to steadily rising temperature and be vaporized. Gaseous nitrogen is led to the annular space 8 and flows in a direction towards the interior of the oven and, when the gas has passed the downstream end of the methanol conduit 4, it will entrain the methanol from the conduit 4. Because of the high temperature prevailing in the oven, the lance 1 cannot be protruded further into the oven, since the temperature at the downstream end of the lance 1 would rapidly rise to a temperature at which thermal breakdown of the methanol would already take place within the lance itself. As a result of this disposition of the downstream end of the lance 1, methanol will impinge upon the channel wall where soot can usually be formed.

The lance 11 according to the present invention, as schematically illustrated in section through the longitudinal axis thereof, comprises a cylindrical member 23 which defines a chamber 12, with an inlet aperture 13 in one end of the lance and an outlet aperture 14 in the other end of the lance 11. A nozzle 15 is disposed in the inlet aperture 13 and has an inlet 16 for gas and an inlet 17 for liquid. The inlet 17 for liquid merges in a channel 18 parallel with the cylindrical chamber 12, the channel 18 discharging into an atomization chamber 20 and, ahead of the merge into the chamber 20, displays a smaller cross-sectional area than in its remainder. The inlet 16 for gas merges into three parallel channels 19 which are parallel with the channel 18 and of which but one is shown. These channels 19 are confluent with the channel 18 in the atomization chamber 20. The chamber 20 displays an aperture 21 which discharges in the chamber 12 and is disposed downstream of the channel 18 a short distance from the discharge of the channel 18. In the outlet aperture 14 of the other end of the chamber, a second nozzle 22 is disposed, with a relatively slight outlet aperture 24. The nozzle 22 is preferably designed so as to impart a vortex to gas flowing therethrough, there being obtained a conical, more—or preferably less—divergent jet.

When the lance according to FIG. 2 is to be used, it is inserted and centered in an oven channel. Carrier gas, normally nitrogen, is supplied to the lance through the aperture 16 and then flows further through the three channels 19 and into the chamber 20. Simultaneously, a liquid, for instance methanol, an aqueous mixture of ethanol, or propanol, is supplied through the inlet 17 and is thereafter caused to flow parallel in the longitudinal direction of the lance, not coming into contact with the carrier gas until reaching the chamber 20, and departing, together with the carrier gas, from the atomization chamber 20 through the aperture 21 and flowing into the vaporization chamber 12. The liquid is vaporized in the chamber 12 and departs thence through the nozzle 22, a slightly conical divergent vortex being imparted to the carrier gas and the vapour, spreading in the interior of the oven. Since the liquid is caused to vaporize in the lance, heat will be absorbed from the lance which is thereby cooled. The proportion and relationship between water and alcohol is such that, on breakdown of the alcohol, only carbon monoxide and hydrogen will be obtained—at least in theory.

FIG. 3 shows a graph in which the temperature of the tip of the lance is set out as a function of the distance from the outer side of the oven wall. It will be apparent from this figure that, after a certain insertion length of the tip, a powerful temperature increase will be obtained. This length corresponds to a thermal capacity in the oven wall, in which more heat is supplied to the lance than is consumed for vaporizing the total volume of supplied liquid. According to one preferred embodiment of the present invention, the tip of the lance is placed in such a position as to lie at the break point indicated by an arrow or at that part of the curve with the lower directional coefficient a short distance from the indicated point. The slope of the curve and the distance of the lance tip from the outside of the wall are dependent int. al. on the temperature of the oven. For this reason, no scale markings are given on the abscissa.

The lance in FIG. 4 embodies the lance 11 of FIG. 2 as an essential component part. Outside the chamber 12, there is disposed a tube 31 concentric therewith, and, for instance, consisting of a refractory alloy, this tube sealingly connecting, through the intermediary of a rear annular wall 32, with the tubular member 23 which constitutes the cylindrical wall of the chamber 12. The tube 31 surrounds the greater part of the tubular member 23 and extends further in the forward direction than the vaporization chamber 12 with the nozzle 22. The distance to the forward edge of the tube 31 from the nozzle 22 is adapted such that the diverging jet emanating from the aperture 24 of the nozzle 22 does not impinge upon the tubular member 23, irrespective of that pressure which may, under normal operational conditions, prevail. An inlet 33 for carrier gas is disposed in the rear portion of a chamber 36 formed by the wall 32, the inner surface of the tube 31 and the outer surface of the chamber 12. A conduit 34 for carrier gas which is connected to the inlet 16 displays a branch 35 which is connected to the inlet 33 of the annular chamber 36. The conduit 35 displays a spring-loaded non-return valve 37 which allows gas to flow to the chamber 36 when the pressure in the conduit 34 exceeds a predetermined pressure threshold. The gas flowing through the chamber 36 entrains the mixture of gas and vapour from the chamber 12, the dissipation of this mixture from the longitudinal axis of the lance being reduced.

The non-return valve 37 may be selected such that it is opened when the pressure in the conduit 34 exceeds a predetermined threshold which corresponds to that pressure which is desired or required in the atomization chamber 20. One advantage inherent in the lance according to FIG. 4 is that it is thereby possible to supply carrier gas and liquid in a considerably greater gas/liquid proportional ratio than with the lance according to FIG. 2. A further advantage is that but a single flowmeter is necessary for governing the volume of gas through the vaporization chamber and through the chamber 36.

Lances according to the present invention may be inserted considerably further into the oven wall than, for example, a lance according to FIG. 1. By way of example, a lance according to FIG. 2 has proved to accept being inserted so far into the wall that its tip is located approximately 800 mm from the outer surface of the oven wall, while a lance according to FIG. 1 could, under the same conditions, only be inserted a distance of approx. 400 mm.

What we claim and desire to secure by letters patent is:

1. A method of supplying with a lance a substance which is liquiform at ambient temperature to a heat treatment oven, the substance being vaporized by the oven heat and introduced into the oven with the assistance of a carrier gas, wherein the liquid, with the carrier gas, is atomized in an end of the lance facing away from the interior of the oven; that the atomized liquid and the carrier gas are supplied to a vaporization chamber with an outlet aperture directed towards the interior of the oven, in which chamber the atomized liquid is vaporized by the oven heat during simultaneous cooling of the chamber; and that the thus formed vapour and carrier gas are caused to depart from the vaporization chamber of the lance through the aperture forming a nozzle.

2. The method as claimed in claim 1, wherein the vapour and gas are caused to depart from the nozzle as a divergent jet.

3. The method as claimed in claim 1 or 2, wherein a vortex is imparted to the vapour and gas on their passage through the nozzle.

4. The method as claimed in any one of claims 1–3, wherein the liquiform substance is methanol or an aqueous solution of ethanol or propanol.

5. The method as claimed in any one of claims 1–3, wherein a gas current is caused to flow through an annular channel outside the vaporization chamber, said channel merging, after the vaporization chamber, into a circular channel, the gas flow entraining the vapour and carrier gas after the aperture of the vaporization chamber.

6. The method as claimed in any one of claims 1–3, wherein the insertion of the lance into the oven wall is regulated such that thermal breakdown of the liquid only takes place outside the vaporization chamber.

* * * * *